United States Patent [19]

Mainka

[11] 4,103,627

[45] Aug. 1, 1978

[54] STOKER AND GRATE THEREFORE

[75] Inventor: Christian M. Mainka, Bayside, N.Y.

[73] Assignee: Morse Boulger, Inc., New York, N.Y.

[21] Appl. No.: 779,988

[22] Filed: Mar. 22, 1977

Related U.S. Application Data

[63] Continuation-in-part of Ser. No. 610,439, Sep. 4, 1975, abandoned.

[51] Int. Cl.[2] ..... F23B 1/22; F23C 7/00

[52] U.S. Cl. ..... 110/281; 110/298

[58] Field of Search ..... 110/8 R, 33, 38, 72 R, 110/73 R, 74 R

[56] References Cited

U.S. PATENT DOCUMENTS

| | | | |
|---|---|---|---|
| 1,211,755 | 1/1917 | Reagan | 110/38 |
| 1,435,948 | 11/1922 | Brunt | 110/74 |
| 1,913,396 | 6/1933 | Kay | 110/38 |
| 2,391,600 | 12/1945 | Stone | 110/38 |
| 2,806,439 | 9/1957 | Wagner | 110/38 |
| 3,413,938 | 12/1968 | Dvirka | 110/38 |
| 3,508,535 | 4/1970 | Martin et al. | 110/74 |

*Primary Examiner*—Kenneth W. Sprague
*Attorney, Agent, or Firm*—Mason, Fenwick & Lawrence

[57] ABSTRACT

A stoker consisting of a support frame, a first plurality of longitudinally spaced sets of grates mounted on the support frame, a second plurality of longitudinally spaced sets of grates mounted on the support frame, each set of the second plurality of sets of grates being interposed between the set of the first plurality of sets of grates and another set of grates, each of the sets of grates consisting of a plurality of transversly spaced grates, each of the grates having an underside surface for seating the grates and an upper surface for supporting a grate of a longitudinally successive set of grates, each transversely successive pair of grates having laterally projecting, overlapping flanges providing a tortuous air passageway between such successive pair of at least one each of the flanges terminating at a point disposed in spaced relation to the underside surface of the grate to provide a substantially longitudinal air passageway between transversely successive grates, and means for reciprocating the second plurality of sets of grates relative to the first plurality of sets of grates.

30 Claims, 14 Drawing Figures

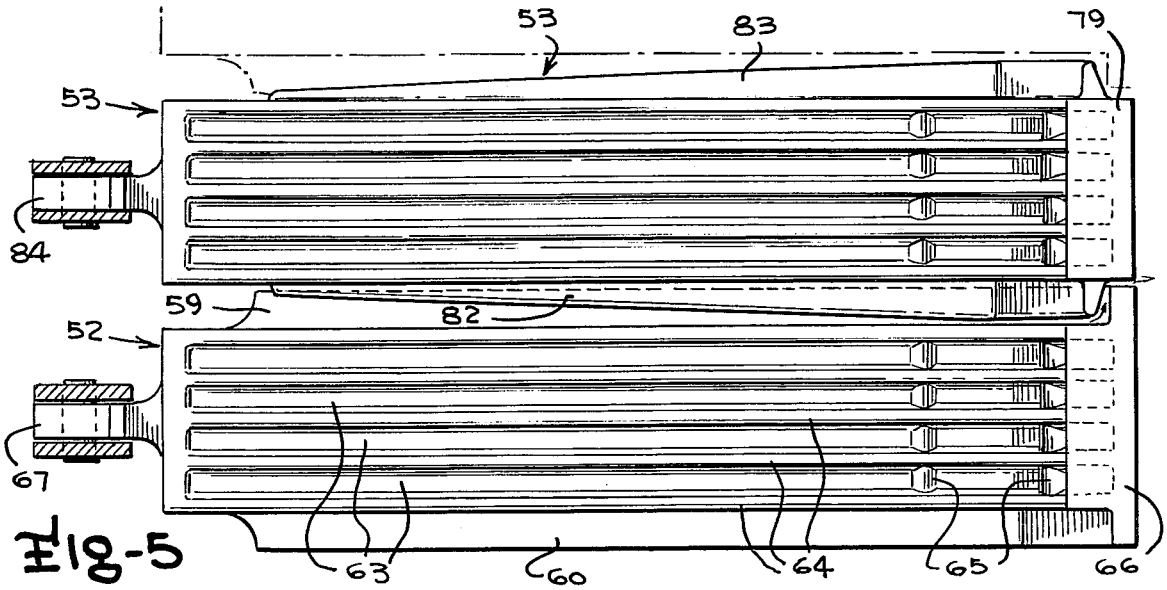
Fig-5
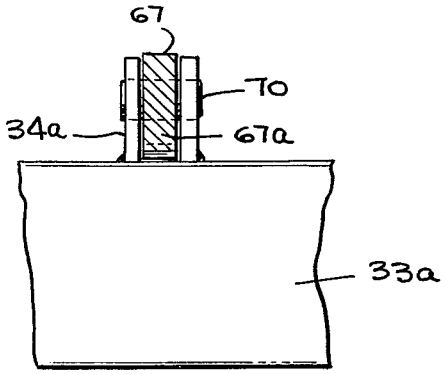
Fig-7
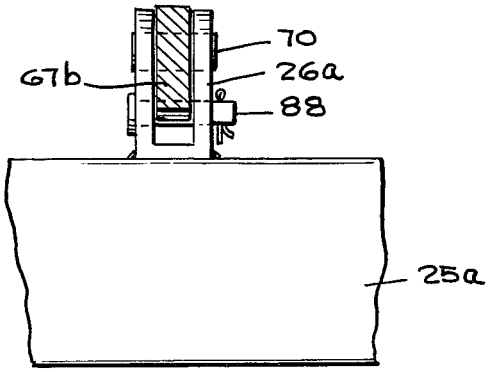
Fig-8
Fig-6
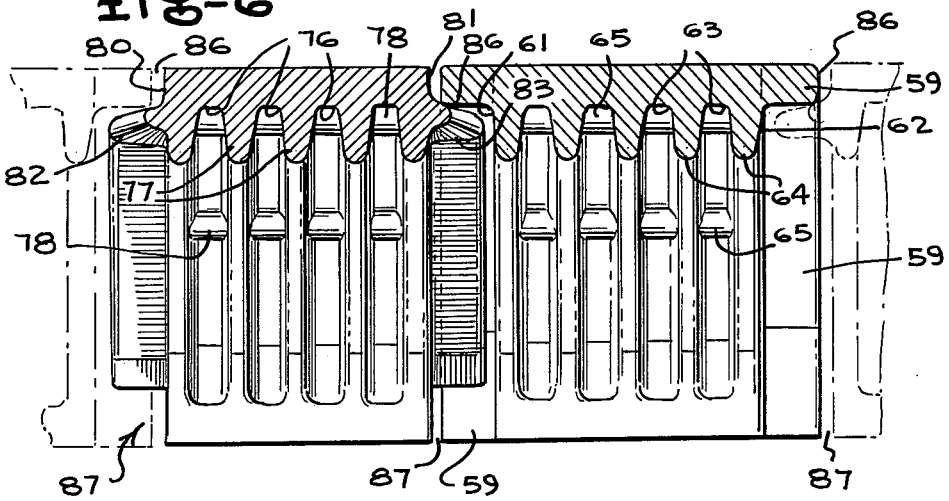

STOKER AND GRATE THEREFORE

This application forms a continuation-in-part of Application Ser. No. 610,439 filed Sept. 4, 1975, now abandoned.

This invention relates to a stoker and more particularly to a stoker suitable for use in a municipal, industrial or institutional type of incinerator. The invention further contemplates a novel grate construction.

In most conventional stokers used in municipal, industrial and institutional incinerators, there usually is provided a plurality of stationary and reciprocable sets of grates which coact to advance and stoke refuse charged onto the stoker, while it is being burned. Normally, to support the combustion of the refuse, both overfire and underfire air is supplied to the combustion zone of the stoker. The overfire air usually is supplied through inlets provided on the side walls and ceiling of the combustion chamber while underfire air is introduced into the combustion zone through and between the grates of the stoker.

In stokers of the type described, it has been found that often, because of the stoker and grate design, refuse particles obstruct or at least impair underfire air passageways thus resulting in an insufficient supply and distribution of underfire air and excessive heating of grates which correspondingly results in grate deterioration and subsequent failure. It thus has been found to be highly desirable to provide stoker and grate constructions in which underfire air will be supplied to the combustion zone in an incinerator both continuously and uniformly thus maximizing the combustion process and preventing the overheating of the stoker components and particularly the grates of the stoker.

Accordingly, it is the general object of the present invention to provide a novel stoker.

Another object of the present invention is to provide a novel stoker suitable for use in municipal, industrial and institutional incinerators.

A further object of present invention is to provide a novel stoker for an incinerator, utilizing overfire and underfire air.

A still further object of the present invention is to provide a novel stoker for an incinerator which is functional to maximize the combustion of refuse charged onto the stoker and minimize the amount of deterioration and failure of the components of the stoker.

Another object of the present invention is to provide a novel stoker utilizing overfire and underfire air in which a continuous supply and uniform distribution of underfire air is assured to maximize the combustion of refuse charged onto the stoker and to minimize excessive heating of any of the components of the stoker and particularly the grates thereof.

A further object of the present invention is to provide a novel stoker provided with interacting stationary and reciprocating grates wherein the failure of any of the grates will not interfere with the continued operation of the stoker.

A still further object of the present invention is to provide a novel stoker which is comparatively simple in construction, reliable in performance and readily adaptable for servicing.

Another object of the present invention is to provide a novel grate construction.

A further object of the present invention is to provide a novel grate construction for a stoker adapted for use in municipal, industrial and institutional incinerators.

A still further object of the present invention is to provide a novel grate for a stoker utilizing overfire and underfire air to support combustion of refuse on the stoker, which assures a continuous supply and uniform distribution of underfire air to refuse supported on such a grate, undergoing combustion.

Another object of the present invention is to provide a novel grate assembly for a stoker which is adapted to maintain a grate in position after a portion thereof has been broken off thus minimizing the amount of interference of the stoker normally caused by the failure of such a grate.

Another object of the present invention is to provide a novel grate assembly for a stoker in which no single grate can be lifted individually by debris such as glass or metallic globules becoming wedged or adhering between adjacent grates.

Other objects and advantages of the present invention will become more apparent to those persons having ordinary skill in the art to which the present invention pertains, from the following description taken in conjunction with the accompanying drawings wherein:

FIG. 5 is a cross-sectional view taken along line 5—5 in FIG. 2;

FIG. 6 is a cross-sectional view taken along line 6—6 in FIG. 2;

FIG. 7 is a cross-sectional view taken along line 7—7 in FIG. 2;

FIG. 8 is a cross-sectional view taken along line 8—8 in FIG. 2;

Figure 1:
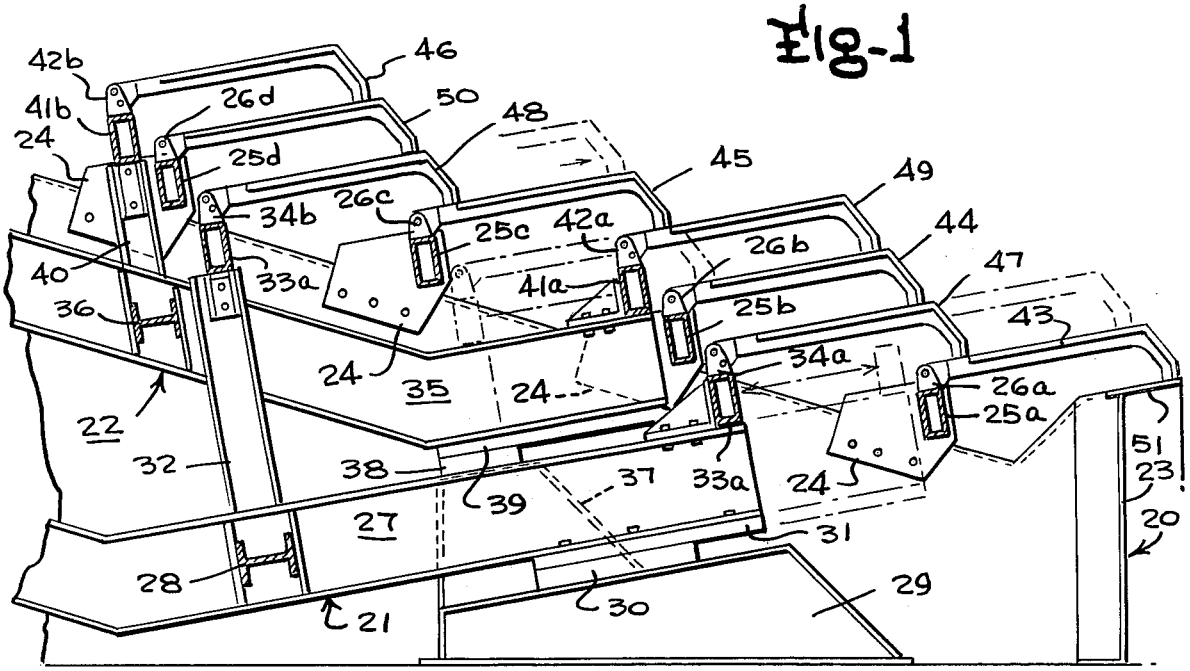
FIG. 1 is a vertical cross-sectional view of a stoker embodying the present invention.

The stoker illustrated in FIG. 1 of the drawings is similar in construction and operation to the stokers disclosed in U.S. Pat. Nos. 3,413,938, dated Dec. 3, 1968, and 3,585,947, dated June 22, 1971. The stoker generally includes a support frame 20 which is adapted to be positioned within a municipal, industrial or institutional type of incinerator, a first carriage assembly 21 mounted on the support frame, a second carriage assembly 22 also mounted on the support frame and a drive system (not shown), functionally similar to the drive systems disclosed in the aforementioned patents, which is operatively connected to carriage assemblies 21 and 22 to reciprocate each of them along their respective lines of travel relative to the other carriage assembly and the support frame.

Support frame 20 includes a front end, transversely disposed wall 23, a rear end, transversely disposed wall (not shown) and a pair of spaced side walls interconnecting the front and rear end walls. Each of the side walls is provided with an upwardly and rearwardly disposed upper edge on which there is rigidly secured a plurality of longitudinally spaced support brackets 24. Such brackets support a plurality of transversely disposed crossbeam members 25. Rigidly mounted on each of such crossbeam members is a plurality of transversely spaced mounting brackets 26.

Carriage assembly 21 is disposed within the support frame and includes a pair of longitudinally disposed, transversely spaced beams 27 interconnected along the lengths thereof by suitable crossbeam members 28. The front end of carriage assembly 21 is supported on a pair of transversely spaced pedestals 29 and the rear end thereof is supported on a similar set of support pedestals. As best illustrated in FIG. 1, the upper ends of support pedestals 29 are provided with seating pads 30 which lie in the same inclined plane, intersecting the plane of the upper edges of the stoker side walls. Similar seating pads are provided on the rear support pedestals, which are disposed substantially at the same angle. The front end of carriage assembly 21 is provided with a pair of shoes 31 which are seated on support pads 30. The rear end of the carriage assembly is provided with a similar set of shoes supported on the rearwardly disposed support pedestals. It thus will be seen, that as carriage assembly 21 is reciprocated, it will be caused to move in a plane disposed approximately 20° to the horizontal.

Spaced along the length of beams 27 is a plurality of upstanding brackets 32. The front ends of beams 27 and the upper ends of brackets 32 support a plurality of crossbeam members 33 which lie in a plane disposed substantially parallel to the plane of crossbeam members 25. Each of crossbeam members 33 is provided with a plurality of transversely spaced mounting brackets 34 which are disposed substantially in longitudinal alignment with mounting brackets 26.

Carriage assembly 22 is similar in construction to carriage assembly 21. Specifically, it includes a pair of longitudinally disposed, transversely spaced beams 35 disposed inwardly of beams 27 and interconnected along the lengths thereof by suitable crossbeam members 36. The front end of carriage assembly 35 is supported on a pair of transversely spaced pedestals 37 and the rear end thereof is supported on a similar set of pedestals. The upper ends of pedestals 37 are provided with seating pads 38 which lie in the same plane, parallel to the plane of seating pads 30. Similar seating pads are provided on the rear pedestals which are disposed substantially at the same angle. The front end of carriage 22 is provided with a pair of shoes 39 which are seated on support pads 38. The rear end of the carriage assembly is provided with a similar set of shoes supported on the seating pads of the rearwardly disposed pedestals. As in carriage assembly 21, when carriage assembly 22 is reciprocated, it will be caused to move in a plane disposed approximately 20° to the horizontal.

Spaced transversely along the length of beams 34 are a number of upstanding brackets 40. A plurality of crossbeam members 41 are secured to the front ends of beams 35 and the upper ends of brackets 40. Crossbeam members 41 lie in a plane disposed parallel to the planes of crossbeam members 25 and 33, each being provided with a plurality of transversely spaced mounting brackets 42.

Mounted on the support frame and carriage assemblies 21 and 22 is a plurality of sets 43, 44, 45, 46, etc., of stationary grates, a first plurality of sets 47, 48, etc., of movable grates and a second plurality of sets 49, 50, etc., of movable grates. As best illustrated in FIG. 1, the grates of set 43 are supported at their front end on a ledge 51 mounted on the upper end of front end wall 23 and are pivotally connected at their rear ends to brackets **26*a*. The grates of set 47 are seated at their front ends on the grates of set 43 and are pivotally connected at the rear ends thereof at brackets 34*a*. The grates of set 44 are seated at the front ends thereof on the grates of set 47 and are pivotally connected at the rear ends thereof to brackets 26*b*. The grates of set 49 are seated at their front ends at grate set 44 and are pivotally connected at the rear ends thereof to brackets 42*a*. The stationary grates of set 45 are seated at the front ends thereof on grate set 49 and are pivotally connected at the rear ends thereof to brackets 26*c*. Similarly, the grates of set 48 are supported at the front ends thereof on grate set 45 and are pivotally connected at the rear ends thereof to brackets 34*b*. The grates of sets 50 and 46 are mounted similarly. It thus will be seen that when carriage assemblies 21 and 22** are reciprocated, each of the pluralities of sets of movable grates will reciprocate relative to the other plurality of sets of movable grates and the plurality of sets of stationary grates to advance and stoke refuse deposited on the stoker.

Figure 3:
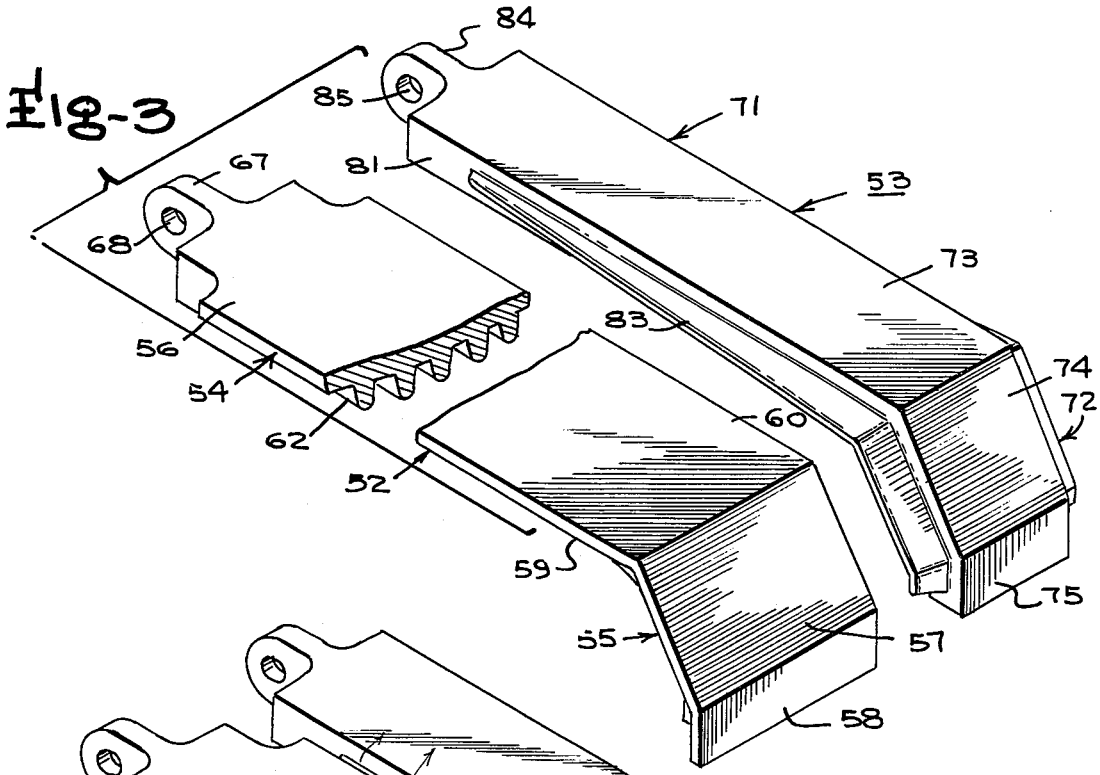
FIG. 3 is a perspective view of a pair of transversely successive grates utilized in the stoker shown in FIG. 1.
Figure 4:
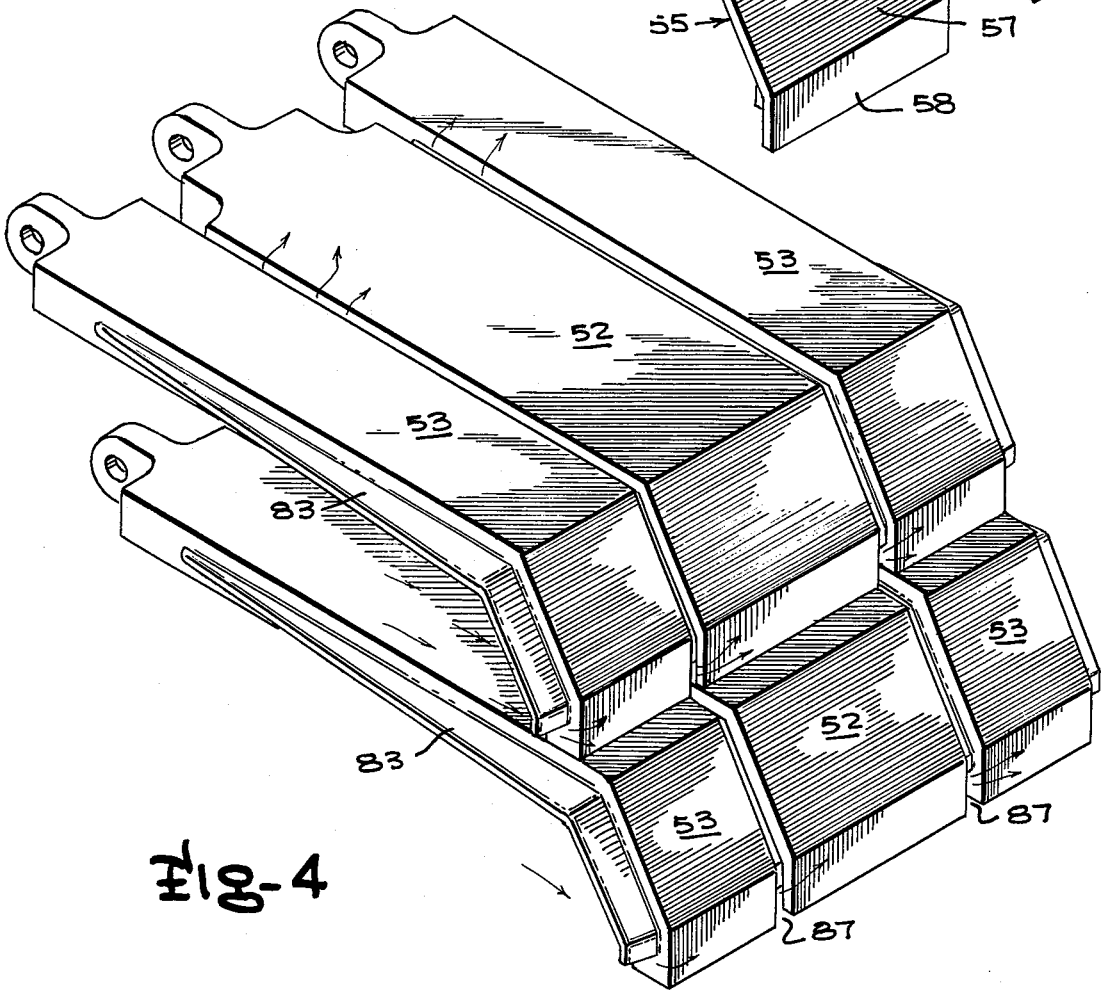
FIG. 4 is a perspective view of two sets of grates utilized in the stoker illustrated in FIG. 1.

Referring to FIGS. 3 through 6, each set of grates consists of two types of grates 52 and 53 positioned alternately across the width of the stoker. Grate 52 includes an elongated body section 54 and a forwardly disposed, depending section 55. The upper side 56 of body section 54 is substantially planar and is adapted to support the front end of a longitudinally successive grate, as illustrated in FIG. 4, and refuse being burned. Body section 54 includes an upper, inclined surface 57 and a lower front face 58. Disposed substantially along the entire length of grate 52 are laterally projecting flanges 59 and 60 having the upper surfaces thereof formed flush with surface 56 of the elongated body section of the grate. As best illustrated in FIG. 6, the grate is provided with side surfaces 61 and 62 and a plurality of longitudinally disposed recesses 63 along the underside thereof to provide a plurality of ribs or fins 64 on the underside of the grate. Such ribs or fins are joined by a number of transversely disposed ribs or fins 65. The ribbed or finned configuration of the bottom of grate 52 functions not only to enhance the dissipation of heat thus avoiding excessive heating which could result in material deterioration or failure, but further to impart strength and rigidity to the grate. As best seen in FIG. 5, the underside of depending section 55 is provided with a surface 66 adapted to be seated on the upper side of a lower, successive grate.

Figure 2:
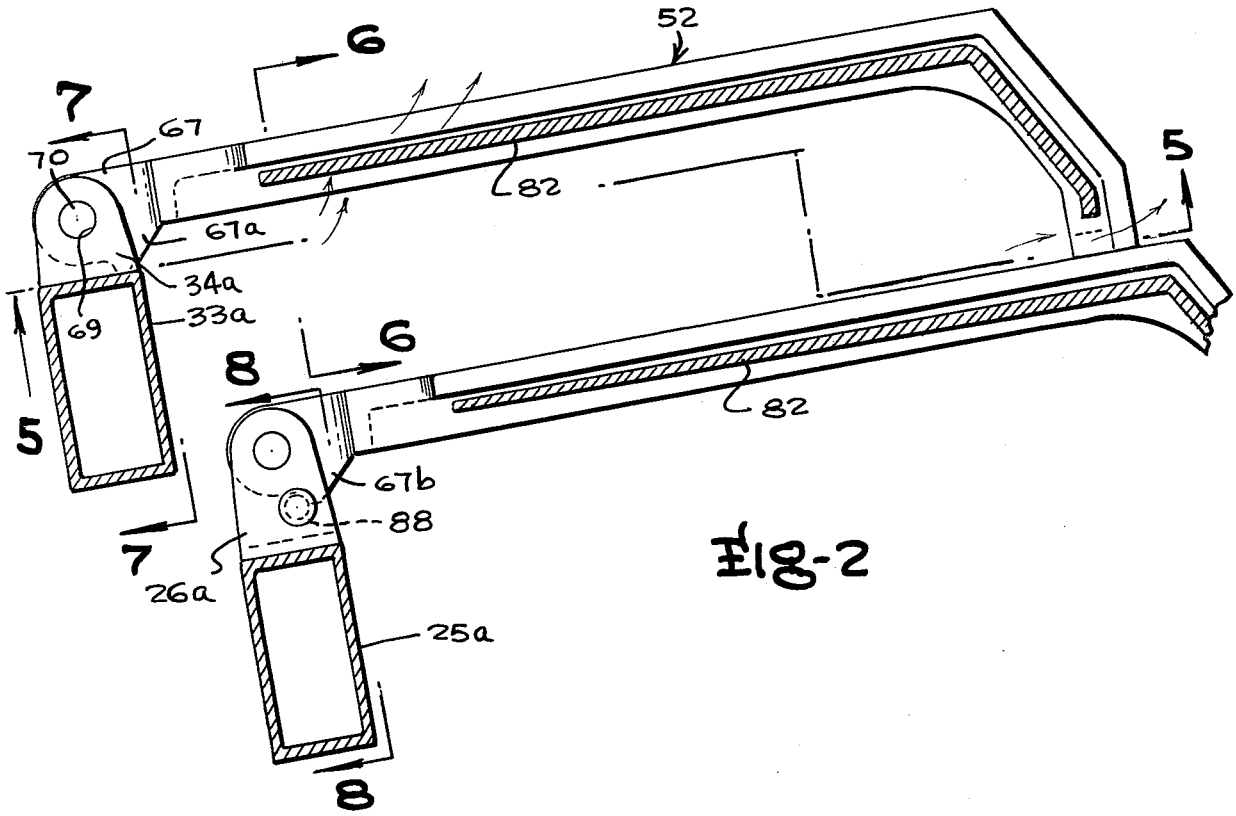
FIG. 2 is an enlarged vertical cross-sectional view of a pair of longitudinally successive grates consisting of a part of the stoker shown in FIG. 1.

The rear end of grate 52 is provided with a rearwardly disposed hub 67 having an opening 68 therein adapted to register with a pair of openings 69 in a mounting bracket **34*a* to receive a pin 70 therethrough to pivotally connect the rear end of grate 52 to a crossbeam member 33*a*. As best seen in FIG. 2, hub 67 is provided with a depending lug 67*a* which is adapted to engage the upper end of crossbeam member 33*a*** to restrict the downward pivotal movement of the grate.

Grate 53 consists of an elongated body section 71, and a forwardly disposed depending section 72. The grate is provided with an upper surface 73 adapted to lie in the same plane as upper surface 56 of grate 54, an inclined surface 74 disposed in the same plane as surface 57 of grate 52, and a front face 75 disposed in the same plane as front face 58 of grate 52. As best illustrated in FIGS. 5 and 6, the underside of grate 53 is provided with a plurality of longitudinally disposed recesses 76 providing a plurality of ribs or fins 77. Also, the underside of grate 53 is provided with transversely disposed ribs 78 which cooperate with ribs 77 to enhance the dissipation of heat and improve the strength and rigidity of the grate. The front end of the grate also is provided with an under surface 79 which is adapted to be seated on the upper surface 73 of a lower, successive grate 53.

Grate 53 further is provided with a pair of side walls 80 and 81 having a pair of laterally projecting flanges 82 and 83. As best shown in FIGS. 3 and 5, flanges 82 and 83 are relieved or diminished in lateral projection along the length of the grate, and the forwardly disposed ends of such flanges terminate at points spaced above bottom surface 79 of the grate.

Grate 53 similarly is provided with a rearwardly projecting hub portion 84 provided with an opening 85 to permit the pivotal connection of the rear end of grate 53 to a mounting bracket on a crossbeam member as described in connection with hub portion 67 of grate 52.

The mounting brackets on the crossbeam members are spaced at a sufficient distance to permit a pair of successive grates 52 and 53 to be positioned as illustrated in FIGS. 5 and 6 with a flange 59 or 60 of a grate 52 overlapping a flange 82 or 83 of a grate 53. Under such circumstances, there will be provided a tortuous, substantially vertical restricted passageway 86 between each pair of successive grates and a substantially longitudinal restricted passageway between the lower, front ends of such grates. When the stoker is in operation and underfire air is supplied to the stoker, such air will be caused to flow through passageways 86 and 87, sweeping siftings from such passageways, thus preventing such sifting from impairing the operation of the stoker, and cooling an extended area of the grates, while providing combustion air for the burning refuse deposited on the grates.

In the event the front end of any of the grates breaks off, the remaining portion of the grate is prevented from pivoting downwardly by lug 67*a* and perhaps interfering with the operation of the stoker; in this regard, it will be appreciated that lug 67*a* will engage the upper end of the crossbeam member to prevent the unbroken portion of the grate from falling downwardly.

Figure 9:
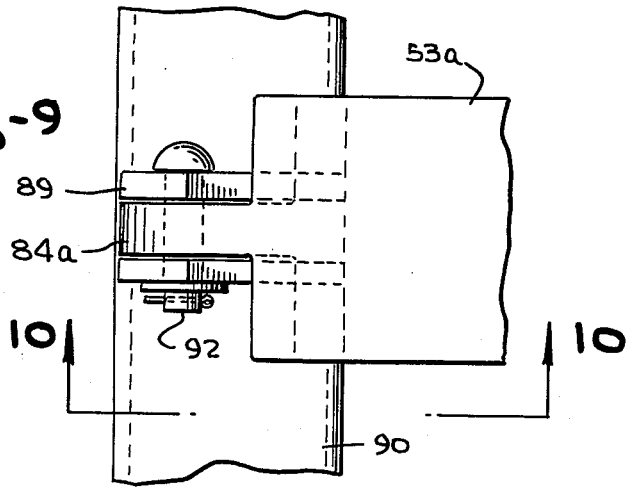
FIG. 9 is a fragmentary, top plan view of another modification of the mounting means of a grate utilized in the stoker illustrated in FIG. 1.
Figure 10:
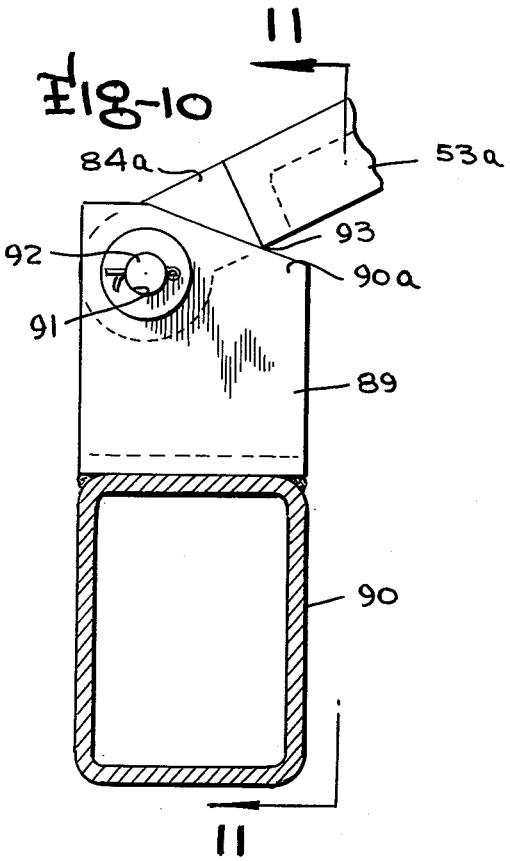
FIG. 10 is a cross-sectional view taken along line 10—10 in FIG. 9.
Figure 11:
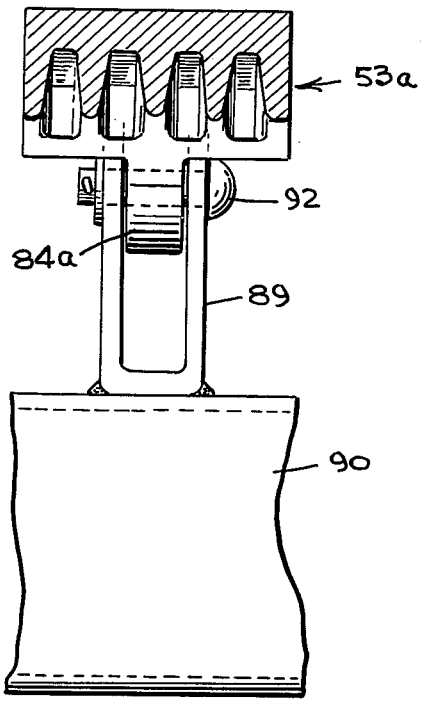
FIG. 11 is a cross-sectional view taken along line 11—11 in FIG. 10.

The lower grate in FIG. 2 is illustrated with an alternate form of means for restricting the downward pivotal movement of the grate. In particular, such alternative form involves a depending lug 67*b* which is adapted to engage a transversely disposed pin 88 mounted on the mounting bracket. A further alternative form of means for restricting the downward pivotal movement of a grate is illustrated in FIGS. 9 through 11. Such form consists of a mounting bracket 89 mounted on a crossbeam member 90 having an upper set of inclined surfaces 90*a* and a pair of pin receiving openings 91. The grate 53*a* is formed with a sufficiently short hub 84*a* so that when the hub is pivotally connected to bracket 89 by means of a pin 92 the lower rear edge 93 of the elongated grate section will be engagable with inclined surfaces 90*a* of the mounting bracket to restrict the downward pivotal movement of the grate.

Figure 12:
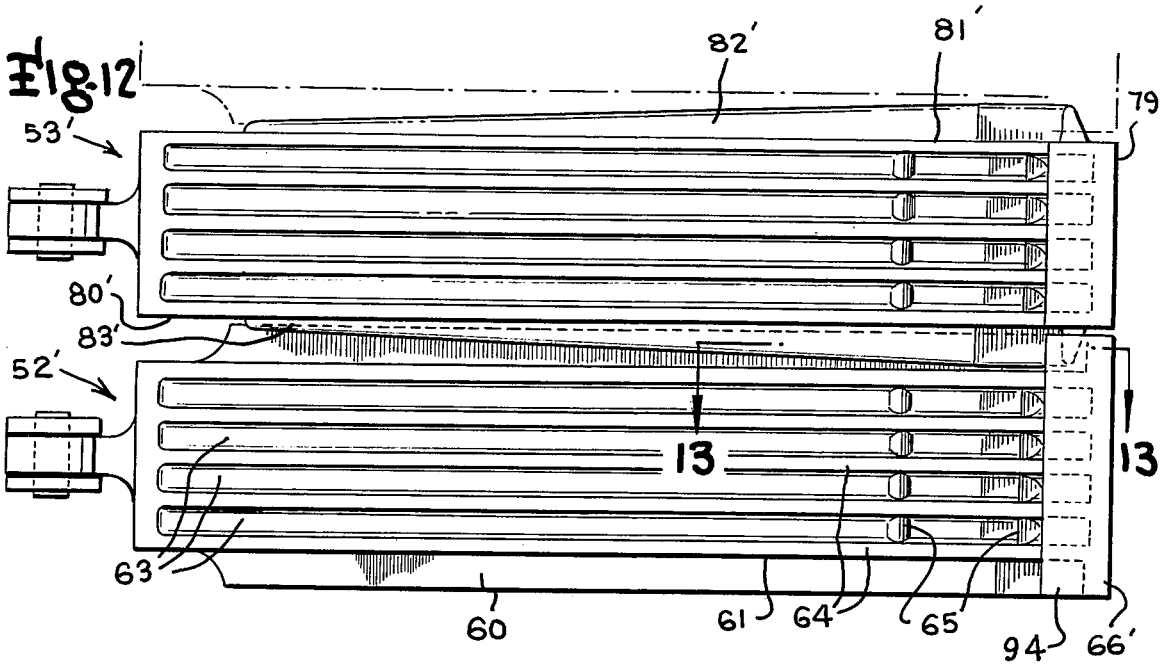
FIG. 12 is an alternate embodiment shown in a cross-sectional view similar to FIG. 5.
Figure 13:
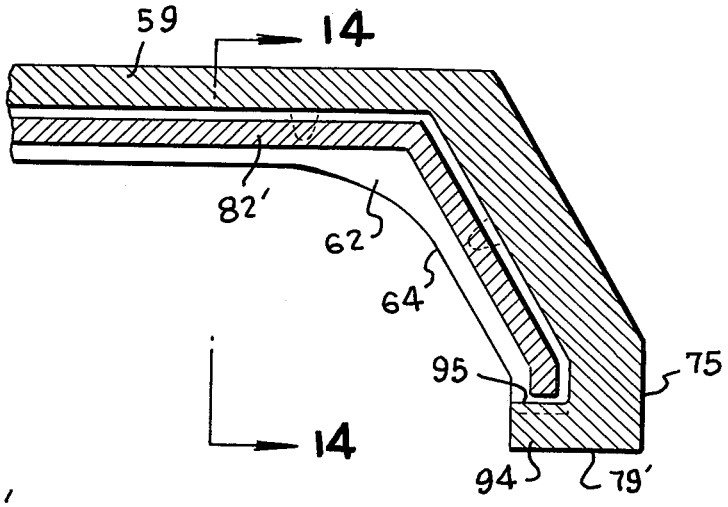
FIG. 13 is a cross-sectional view taken along line 13—13 in FIG. 12.
Figure 14:
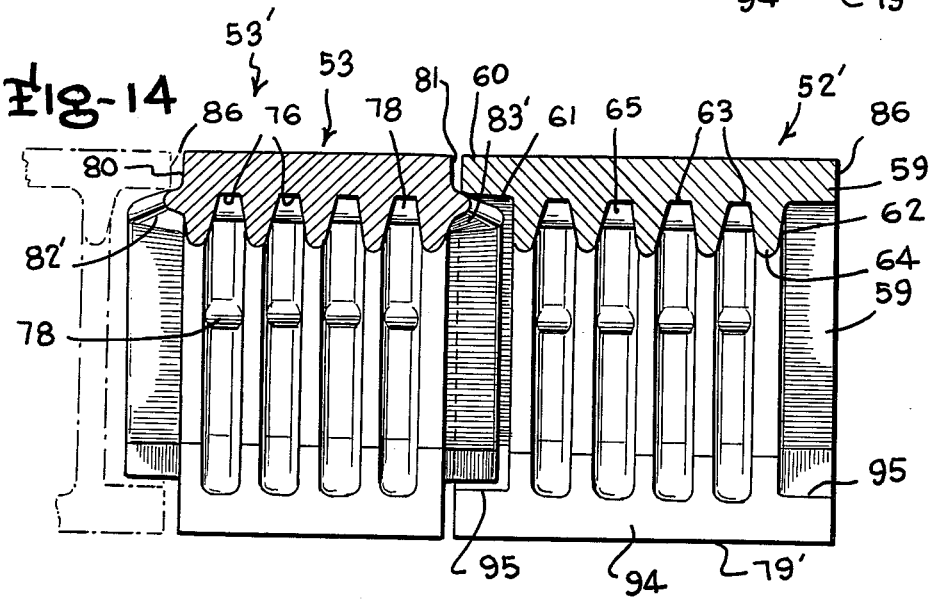
FIG. 14 is a cross-sectional view taken along line 14—14 in FIG. 3.

Referring to FIGS. 12 through 14, there is disclosed alternate embodiments of the grates 52 and 53 which are designated as 52′ and 53′. The features of the alternate grates 52′ and 53′ which are the same as grates 52 and 53 and are identified by the same numeral designations. Projecting rearwardly from the front face 75 on grate 53′ is an extended nose 94, as best shown in FIG. 14, which also projects laterally beyond the side surfaces 61 and 62 of the ribs 64 as shown in FIGS. 12, 13 and 14.

Flanges 82′ and 83′ on grate 53′ have the forwardly disposed ends terminated at points spaced above the upper surface 95 of the extended nose 94 on the grate 52′ when the grates are in the operative overlapping position as shown in FIGS. 12, 13 and 14.

This configuration prevents a buildup of adhering globules of metallic and glass objects which can form in the high temperatures prevailing in incinerators. The globules along with ash and other materials may become wedged between or adhere to the adjacent surfaces of the flanges 82′ and 83′ on grate 53′ and the laterally projecting flanges 59 and 60 on grate 52′. As each grate is interlocked with the adjacent grate, no single grate can be lifted individually. Without the extended nose 94, grate 52′ would move upwardly away from the grate 53′ and upset the proper balance between overfire and underfire air provided for the combustion of the refuse. This feature increases the useful life of the grates by preventing overheating thereof.

With the carriage assemblies in position as illustrated in FIG. 1, the grates may be mounted on the stoker simply by beginning with the foremost set of grates 43 and working backwardly. The grates are mounted on the stoker simply by pivotally connecting the rear ends thereof to the mounting brackets and resting the front ends thereof either on ledge 51 or a lower installed grate. The spacing of the mounting brackets on the crossbeam members will align transversely successive grates so that the flanges thereof will be disposed in overlapping relation, as previously described, providing substantially vertical restricted air passageways 86 and longitudinal restricted passageways 87. With the carriage assemblies connected to the drive system, the stoker may be operated simply by actuating the drive system to reciprocate the carriage assemblies and correspondingly the movable grates relative to each other and the stationary grates.

As previously mentioned, as refuse is deposited on the upper end of the stoker and is ignited, the reciprocating action of the movable grates will stoke the burning refuse and cause it to advance to the lower end of the stoker. Simultaneously, overfire and underfire air is supplied to the upper side of the grates to support the combustion of the refuse. Such underfire air is introduced to the combustion zone through substantially vertical passageways 86 and longitudinal passageways 87. The flow of underfire air through such passageways functions to supply primary combustion air to the burning refuse, uniformly cool the grates and sweep siftings from between the grates.

From the foregoing detailed description, it will be evident that there are a number of changes, adaptions and modifications of the present invention which come within the province of those persons having ordinary skill in the art. However, it is intended that all such variations not departing from the spirit of the invention be considered as within the scope thereof and as limited solely by the appended claims.

I claim:

1. A stoker comprising a support frame, a first plurality of longitudinally spaced sets of grates mounted on said support frame, a second plurality of longitudinally spaced sets of grates mounted on said support frame, each set of said second plurality of sets of grates being interposed between a set of said first plurality of sets of grates and another of said sets of grates, each of said sets of grates comprising a plurality of transversely spaced grates, each of said grates having an underside surface and an upper surface for supporting a grate of a longitudinally successive set of grates, each transversely successive pair of grates having laterally projecting, overlapping flanges providing a tortuous air passage between said successive pair of grates, at least one of said flanges terminating at a point disposed in spaced relation to said underside surface of said grate to provide a substantially longitudinal air passageway between transversely successive grates, and means for reciprocating said second plurality of sets of grates relative to said first plurality of sets of grates.

2. A stoker according to claim 1 wherein one of said flanges of said successive pair of grates is relieved transversely along the length thereof.

3. A stoker according to claim 1 wherein each of said grates is provided with a finned configuration on a portion of the underside thereof.

4. A stoker according to claim 1 wherein each of said grates is pivotally connected to a mounting member for pivotal movement about a transverse axis.

5. A stoker according to claim 4 including means for restricting the downward pivotal movement of said grate.

6. A stoker according to claim 5 wherein said means for restricting the downward pivotal movement of said grate comprises a portion of said mounting means engagable by a portion of said grate.

7. A stoker according to claim 1 wherein each of said grates includes a rearwardly projecting hub pivotally connected to a mounting member for pivotal movement about a transverse axis.

8. A stoker according to claim 7 wherein said mounting member is provided with a surface engagable by said hub to restrict the downward pivotal movement of said grate.

9. A stoker according to claim 7 wherein said mounting member is provided with a surface engagable by a main body portion of said grate to restrict the downward pivotal movement of said grate.

10. A stoker according to claim 1 including a third plurality of longitudinally spaced sets of grates mounted on said support frame, each set of said third plurality of sets of grates being interposed between a set of said first plurality of sets of grates and a set of said second plurality of sets of grates.

11. A stoker according to claim 10 including means for reciprocating said third plurality of sets of grates relative to said first plurality of sets of grates.

12. A stoker according to claim 11 wherein said first plurality of sets of grates is stationary on said support frame.

13. The stoker of claim 1 including means for preventing separation of the overlapping flanges.

14. The stoker of claim 13 wherein said separation preventing means comprises a projection on a grate disposed to engage a portion of an adjacent grate to prevent separation of the overlapping flanges.

15. The stoker of claim 14 wherein said projection is an extending nose projecting below said terminating point of the flange on an adjacent grate thereby preventing any relative vertical movement of the adjacent grates.

16. A stoker comprising a support frame, a first plurality of longitudinally spaced mounting means disposed on said support frame, a first plurality of longitudinally spaced sets of grates mounted on said first set of mounting means, a second plurality of longitudinally spaced mounting means disposed on said support frame, a second plurality of longitudinally spaced sets of grates mounted on said mounting means, each set of said second plurality of sets of grates being interposed between a set of said first plurality of sets of grates and another of said sets of grates, each of said sets of grates comprising a plurality of transversely spaced grates, each of said grates having an underside surface and an upper surface for supporting a grate of a longitudinally successive sets of grates, each of said grates being pivotally connected to a mounting member for pivotal movement about a transverse axis, each of said mounting means including means for restricting the downward pivotal movements of the grates pivotally mounted thereon and means for reciprocating said second plurality of sets of grates relative to said first plurality of sets of grates.

17. A stoker according to claim 16 wherein said means provided on said mounting means for restricting the downward pivotal movements of said grates comprise portions of said mounting means engageable by portions of said grates.

18. A stoker according to claim 16 wherein each of said grates includes a rearwardly projecting hub pivotally connected to a mounting means for pivotal movement about a transverse axis.

19. A stoker according to claim 18 wherein each of said mounting means are provided with surfaces engagable by said hubs of said grates to restrict the downward pivotal movements of said grates.

20. A stoker according to claim 18 wherein said mounting means are provided with surfaces engagable by main body portions of said grates to restrict the downward pivotal movements of said grates.

21. A grate comprising an elongated body having a forwardly disposed, underside surface and a rearwardly disposed means for connecting said grate to a support member, at least one side of said body having a laterally projecting flange adapted to be positioned with a cooperating, laterally projecting flange of a similar grate in overlapping relation, said flange terminating at a forwardly disposed end thereof in spaced relation to said underside surface, and a projection on the grate disposed to engage a portion of an adjacent grate to prevent separation of the overlapping flanges, said projection is an extending nose projecting below said terminating point of the flange on an adjacent grate thereby preventing any relative vertical movement of the adjacent grates.

22. A grate comprising an elongated body having a forwardly disposed, underside surface and a rearwardly disposed means for connecting said grate to a support member, at least one side of said body having a laterally projecting flange adapted to be positioned with a cooperating, laterally projecting flange of a similar grate in overlapping relation, the underside of said body having a finned configuration, and a projection on the grate to prevent separation of the overlapping flanges, said projection is an extending nose projecting below said terminating point of the flange on an adjacent grate thereby preventing any relative vertical movement of the adjacent grates.

23. A grate comprising an elongated body having a forwardly disposed, underside surface and a rearwardly disposed means for connecting said grate to a support member, at least one side of said body having a laterally projecting flange adapted to be positioned with a cooperating, laterally projecting flange of a similar grate in overlapping relation, said flange terminating at a forwardly disposed end thereof in spaced relation to said underside surface, said body including a longitudinal body portion and a forwardly disposed depending body portion, said underside surface disposed on said depending body portion and said flange including a portion projecting laterally of said longitudinal body portion and a portion projecting laterally on said depending body portion.

24. A grate assembly comprising mounting means, a grate having an elongated body portion and a hub portion projecting rearwardly of said body portion, said hub portion having means for connecting said grate to said mounting means for pivotal movement about a transverse axis, and said mounting means having a portion thereof engagable by said grate to restrict the downward pivotal movement of said grate.

25. The stoker of claim 24 including means for preventing separation of the overlapping flanges.

26. The stoker of claim 25 wherein said separation preventing means comprises a projection on a grate disposed to engage a portion of an adjacent grate to prevent separation of the overlapping flanges.

27. The stoker of claim 26 wherein said projection is an extending nose projecting below said terminating point of the flange on an adjacent grate thereby preventing any relative vertical movement of the adjacent grates.

28. A grate assembly according to claim 24 wherein said mounting means includes a transversely disposed member and said hub includes a downwardly projecting lug engageable with said transversely disposed member.

29. A grate assembly according to claim 24 wherein said mounting means includes a bracket provided with a transversely disposed member and said hub of said grate includes a lug engagable with said transverse member to restrict the downward movement of said grate.

30. A grate assembly according to claim 24 wherein said mounting means includes a bracket to which said hub is pivotally connected, and said bracket includes at least one surface engagable with said main body of said grate to restrict the downward pivotal movement of said grate.

* * * * *